US005790682A

United States Patent [19]

Hachiya et al.

[11] Patent Number: 5,790,682

[45] Date of Patent: Aug. 4, 1998

[54] DAMPER FOR SPEAKER

[75] Inventors: Satoshi Hachiya; Masanori Ito; Masatoshi Sato, all of Yamagata-Ken, Japan

[73] Assignees: Pioneer Electronic Corporation, Tokyo; Tohoku Pioneer Electronic Corporation, Yamagata-ken, both of Japan

[21] Appl. No.: 864,482

[22] Filed: May 28, 1997

[30] Foreign Application Priority Data

May 28, 1996 [JP] Japan ..... 8-133551

[51] Int. Cl.[6] ..... H04R 25/00

[52] U.S. Cl. ..... 381/197; 381/194

[58] Field of Search ..... 381/192, 194, 381/197, 199, 195, 202, 203, 204; 29/594, 609.1

[56] References Cited

U.S. PATENT DOCUMENTS 1,907,687 5/1933 Van Lis ..... 381/197

2,147,605 12/1939 Lissauer ..... 381/197

*Primary Examiner*—Huyen Le

*Attorney, Agent, or Firm*—Nikaido Marmelstein Murray & Oram LLP

[57] ABSTRACT

A butterfly damper for preventing an adhesion surface between a speaker frame (6) and an outer peripheral frame (12) from peeling off is provided. The butterfly damper comprises an inside peripheral flame (11), an outer peripheral flame (12) and a plurality of movable arms (13), all of which are formed in a single piece by injection molding of thermoplastic synthetic resin. The thickness T of the outer peripheral flame (12) is thicker than the thickness t of the movable arms (13). In addition, the front and back faces of the outer peripheral flame (12) are formed so that each face protrudes toward the thickness direction respectively from the front face and the back face of the movable arms (13).

8 Claims, 6 Drawing Sheets

DAMPER FOR SPEAKER

BACKGROUND OF THE INVENTION

The present invention relates to a damper for a speaker for supporting a voice coil constituting a speaker unit, and more particularly, to a so-called butterfly damper.

As a speaker unit for converting electric signal to acoustic signal, conventionally, a so-called cone type speaker unit as shown in FIG. 10 is known. As it is well-known, the cone type speaker unit generates electromagnetic force in the axial direction (vertical direction of FIG. 10) of a voice coil 1 by power supply to the voice coil 1 and drives a diaphragm (cone) 3 through a voice coil bobbin 2 wound with the voice coil 1. The cone type speaker unit may be known in variety of constructions for its detail, but its basic construction is, in anyway, as mentioned above. In the illustrated example, a speaker frame 6 is connected to an extremity of a cylinder type yoke cap 4 through a plate 5. A yoke pole 7 and magnets 8, 9 such as permanent magnet are disposed inside the yoke cap 4. The upper end of the voice coil bobbin 2 wound with the voice coil 1 protrudes inside the speaker frame 6, while the inside edge of the diaphragm 3 is supported by this upper end outer peripheral surface. The outer end of the diaphragm 3 is supported by and secured to the speaker frame 6.

The voice coil 1 is supported by a damper 10 through the voice coil bobbin 2 in a way to restrict its position. Namely, the voice coil 1 may shift vertically in FIG. 10, but the voice coil 1 should not contact with opposite members, and at the same time, the voice coil 1 should be held in its regular position when it is at rest. For this purpose, the damper 10 is provided. As the damper 10, conventionally, different configurations and constructions are known such as a spiral damper, a butterfly damper or the like. Now, the butterfly damper, object of the invention, shall be described briefly referring to FIG. 1 showing the first embodiment of the invention.

The butterfly damper (called simply "damper" hereinafter) for speaker as shown in FIG. 1 comprises an inside peripheral frame 11 wherein the voice coil bobbin is inserted, an outer peripheral frame 12 to be supported by the speaker frame, and a plurality of (four in the illustrated example) movable arms 13, 13 bridged between the inside peripheral frame 11 and the outer peripheral frame 12. Such a damper 10 is conventionally manufactured from resin or the like by punching out it. In such a damper 10, the voice coil bobbin 2 is inserted into the inside of the inside peripheral frame 11 while its outer peripheral frame 12 is supported and secured to the speaker frame 6, as shown in FIG. 11, with adhesive 21.

The general configuration of the conventional damper 10 is simply plane as it is manufactured by punching out and molding plate resin material. Namely, respective surface of the inside peripheral frame 11, outer peripheral frame 12 and movable arms 13, 13 are positioned on the same plane while respective back faces are also positioned on the same plane. Here, the damper 10 vibrates with the vibration of the diaphragm (FIG. 10), however, as the damper 10 is simply plane in its configuration, stress concentration occurs in the joining portion between the movable arms 13, 13 and the outer peripheral frame 12 to peel off the bonded portion, or in an extreme case, to break the damper itself. In other words, the vibration may bend the outer peripheral frame 12 so that it accelerates the concerned bonded surfaces to separate. In the conventional damper 10, as both inside and outer peripheral frames 11, 12 and movable arms 13, 13 have the same thickness, it is hard to avoid bending due to the vibration. In order to avoid such bending, the back side of the outer peripheral frame 12 is stiffened by increasing adhesion at the edge section of the bonded surfaces, but its result is not satisfactory. Moreover, it is not desirable because this countermeasure increases the number of process, and consequently, the cost.

Additionally, in the conventional damper 10, excess adhesive may protrude from the bonded surfaces between the speaker frame 6 (FIG. 10) and the outer peripheral frame 12, and in such instance, the protruded adhesive may easily separate by the vibration of the movable arms 13, 13. As the consequence, the repeated application of the vibration may accelerate the whole bonded surfaces to separate.

The present invention has been made considering these problems.

SUMMARY OF THE INVENTION

An object of the present invention is to provide a damper for speaker where an adhesion section between an outer peripheral frame of the damper and a speaker frame is hard to peel off.

According to the present invention, there is provided a damper for speaker comprising an inside peripheral frame wherein a voice coil bobbin is inserted, an outer peripheral frame to be supported by a speaker frame, and a plurality of movable arms bridged between the inside peripheral frame and outer peripheral frame, wherein the inside and outer peripheral frames and plurality of movable arms are molded respectively in a single piece with thermoplastic resin, and the outer peripheral frame is thicker than the plurality of movable arms.

The outer peripheral frame is protruded in the thickness direction respectively from a front face and a back face of the plurality of movable arms.

The thermoplastic resin is a synthetic resin based on polybutyleneterephthalate.

A stiffening rib may be provided near a joining section between the outer peripheral frame and the movable arm.

A communication section may be provided on the outer peripheral frame for communicating the front and back faces of the outer peripheral frame so as to permit adhesive existing on the back face to flow toward the front face.

A stiffening rib may be provided on the inside peripheral frame.

A communication section may be provide on the inside peripheral frame for communicating the front and back faces of the inside peripheral frame so as to permit adhesive existing on the front face to flow toward the back face.

A fluid reservoir for adhesive may be provided on an inside end section of the inside peripheral frame.

Being composed as mentioned above, in the damper for speaker of the present invention, the adhesion faces between the outer peripheral frame and the speaker frame resist the separation thereof. To be more specific, as the outer peripheral frame is thicker than the movable arms, this outer peripheral frame is hard to deflect. In addition, the front and back surfaces of this outer peripheral frame may be protruded respectively from the front face and the back face of the plurality of movable arms, even when adhesive is extruded from the adhesion surface, it will filtrate into the step section between the outer peripheral frame and the movable arms, so that it would not be forced out from the back face of the movable arms. Therefore, the separation of adhesion due to protrusion of adhesive will be prevented. As the consequence, the adhesion surfaces hardly peel off. Moreover, as the damper for speaker of the present invention may be formed in a single piece by injection molding of thermoplastic resin, the outer peripheral frame may be easily made thicker than the movable arms and also the front and back surfaces of the outer peripheral frame may be easily protruded in the thickness direction respectively from the front face and the back face of the plurality of movable arms.

Additionally, by providing the stiffening rib on the joining section between the outer peripheral frame and the movable arms or on the inside end section of the inside peripheral frame, the damper may be made more rigidly so as to ensure further prevention of separating. On the other hand, a communication section or a fluid reservoir may be provided on the outer peripheral frame or the inside peripheral frame in a way to increase adhesion area and thus adhesion effect for preventing the adhesion surface from separating more effectively.

These and other objects and features of the present invention will become more apparent from the following detailed description with reference to the accompanying drawings.

DETAILED DESCRIPTION OF THE PREFERRED EMBODIMENTS

Figure 10:
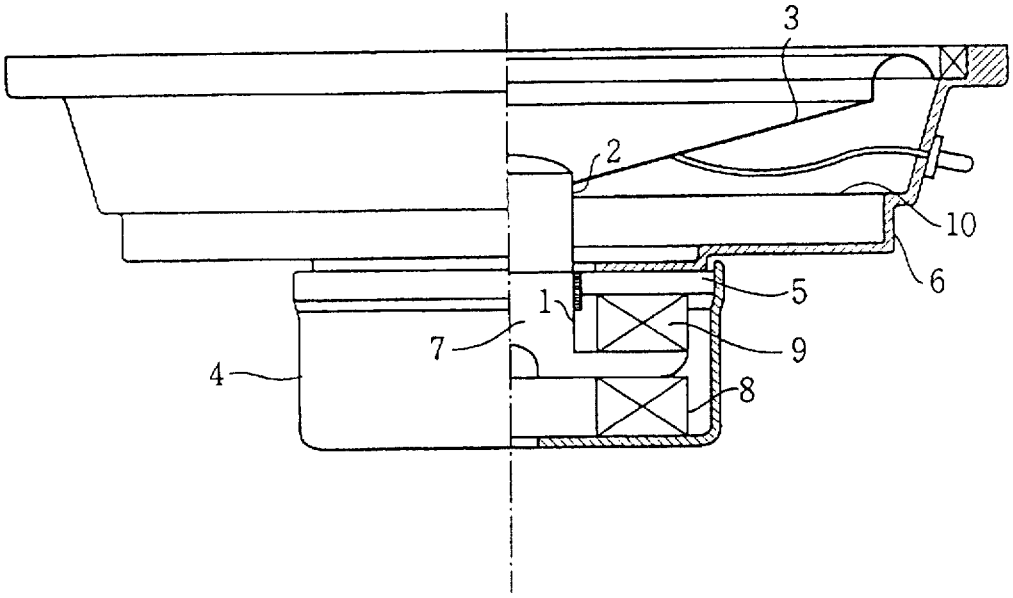
FIG.10 PRIOR ART
FIG. 10 is a half cross-section view showing an example of speaker unit.
Figure 11:
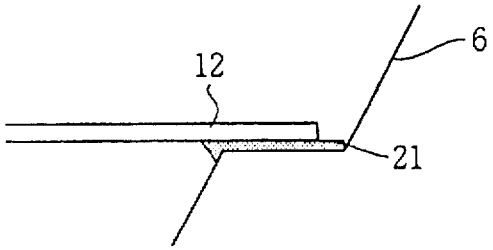
FIG. 11 is a schematic cross-section of essential parts showing the joining state between a speaker frame and an outer peripheral frame.

FIGS. 1 to 4 show a first example of the embodiment of the present invention. As the conventional damper for speaker mentioned above, the damper for speaker of the present invention comprises an inside peripheral frame 11 wherein a voice coil bobbin 2 (FIG. 10) is inserted, an outer peripheral frame 12 to be supported by a speaker frame 6, and a plurality of (four in the illustrated example) movable arms 13, 13 bridged between the inside peripheral frame 11 and the outer peripheral frame 12. In such a damper of this embodiment, the inside peripheral frame, the outer peripheral frame and the plurality of movable arms 13, 13 are formed in one-piece by injection molding of synthetic resin containing polybutyleneterephthalate (PBT) 50% or more in weight. At the same time, the thickness T of the outer peripheral frame 12 is formed thicker than the thickness t of the plurality of movable arms (T>t). Moreover, the front and back surfaces of this outer peripheral frame 12 is protruded in the thickness direction respectively from the front and back faces of the plurality of movable arms 13, 13.

Figure 1:
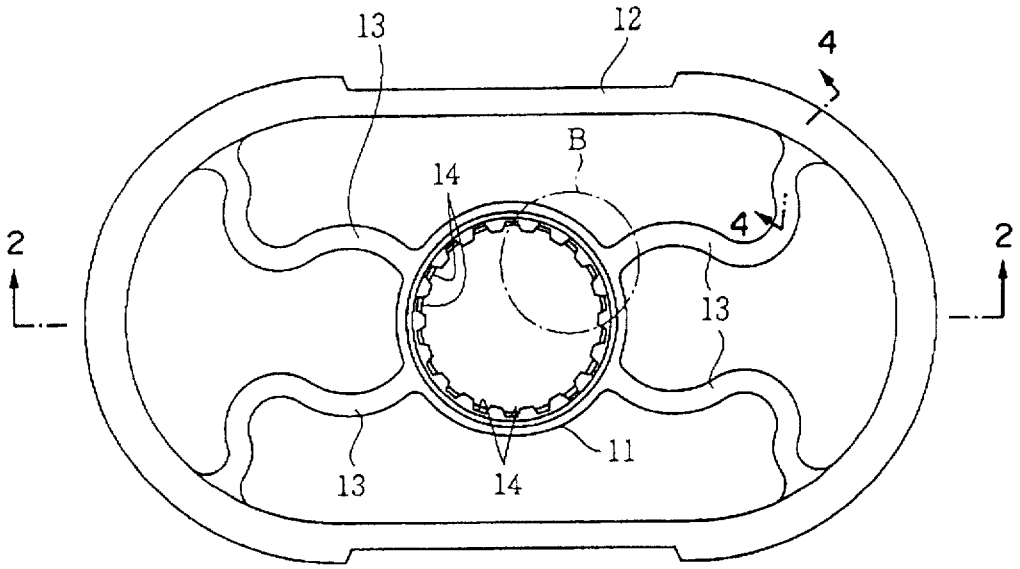
FIG. 1 is a plane view showing the first embodiment of the present invention.
Figure 2:
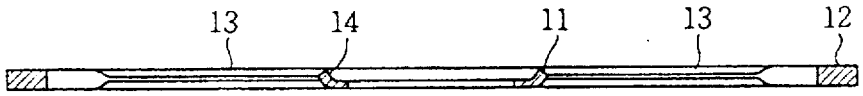
FIG. 2 is a cross-section view along the line A—A of FIG. 1.
Figure 3:
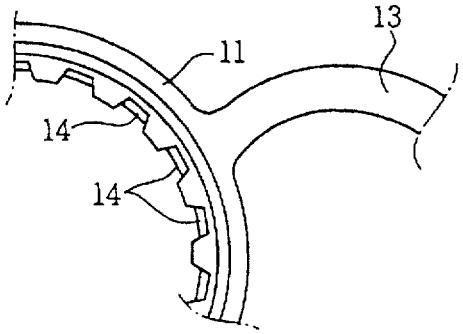
FIG. 3 is an enlarged view of B in FIG. 1.
Figure 4:
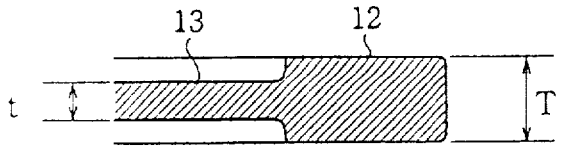
FIG. 4 is an enlarged cross-section view of C—C in FIG. 1.

In this embodiment, additionally, as shown in FIG. 3, notches 14, 14 are provided with equal distance each other on the inside peripheral surface of the inside peripheral frame 11. These notches 14, 14 corresponding to the communication section mentioned in claim 7 allow the communication of the front and back faces of the inside peripheral frame 11 so that adhesive existing on the front face side may flow toward the back face through these notches 14, 14. The section of these notches 14, 14 is configured in taper towards the center direction of the inside peripheral frame as it goes to the back face side, in such a way to facilitate adhesive to flow into. Note that the section of the notches 14, 14 needs not necessarily be configured in such a taper form.

As the conventional damper for speaker mentioned before, in the damper for speaker of the present embodiment composed as mentioned above, the voice coil bobbin 2 is inserted into the inside of the inside peripheral frame 11, the respective contact surfaces thereof are bonded, the outer peripheral frame 12 is mounted on a step section of the speaker frame 6, and the respective contact surfaces thereof are also bonded. In this embodiment, after such adhesion, the adhesion surface hardly separates over any of adhesion surfaces. In other words, in the damper of this embodiment, the thickness T of the outer peripheral frame 12 is formed thicker than the thickness t of the plurality of movable arms, and additionally, the front and back surfaces of this outer peripheral frame 12 is protruded respectively from the front face and the back face of the movable arms 13, 13. In consequence, the stiffness of the outer peripheral frame 12 increases so as to prevent it from bending, thus this joining portion hardly separates. As the outermost end of movables arm 13 and adhesion portions of the outer peripheral frame 12 are positioned being spaced each other, the vibration of movable arms does not propagate directly to the adhesion portion to improve the effect of preventing the separation. Even when excessive adhesive is extruded from the adhesion surface, it will filtrate into the step section between the outer peripheral frame 12 and the movable arms 13, namely it would not be forced out of the back face of the movable arms 13. Therefore, the separation of adhesion due to protrusion of adhesive will be prevented. In consequence, the adhesion surface hardly separates. By the way, the thickness T of the outer peripheral frame 12 shall be determined by design according to the form, purpose of use or others of the speaker unit wherein the damper will be incorporated.

In this embodiment, as notches 14, 14 are formed on the inside peripheral frame 11, when adhesive is applied to the inside edge section of the front face of the inside peripheral frame 11 to bond the inside peripheral frame 11 and the voice coil bobbin 2, some amount of the adhesive filtrates into the back face side of the inside peripheral frame 11 through the notches 14, 14 and bonds the inside peripheral frame 11 on both front and back faces thereof. These notches 14, 14 correspond to the communication section as mentioned in claim 7.

Figure 5A:
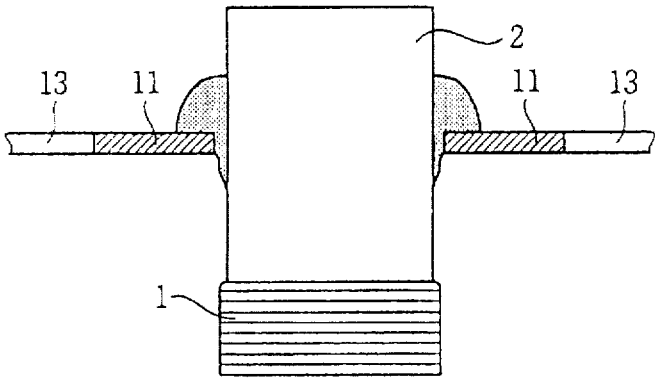
FIGS. 5*a* and 5*b* are schematic cross-section views for illustrating the function of adhesive filtration towards the back face of the inside peripheral frame.
Figure 5B:
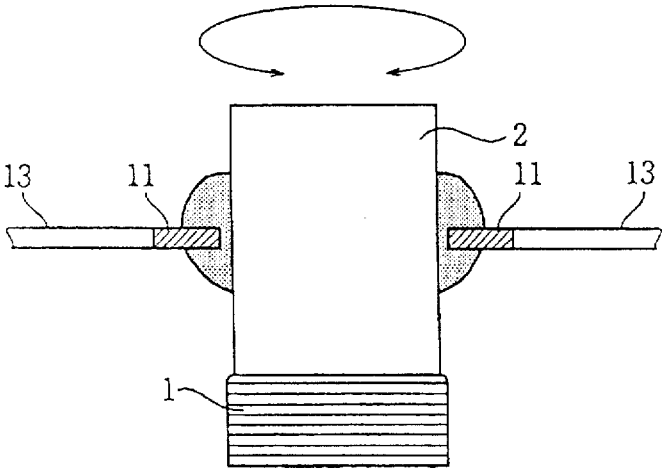

The communication section may also be apertures (not shown) formed on the inside peripheral frame 11. In order to filtrate adhesive towards the back face, after the application of adhesive as shown in FIG. 5(A), the voice coil bobbin 2 may be rotated conveniently as shown in FIG. 5(B). By bonding the inside peripheral frame 11 on both front and back faces in this way, the bonding strength thereof increases and the inside peripheral frame 11 may hardly bend. Therefore, the durability of a speaker unit assembled by using the damper of the present invention will be improved through the effect that not only the outer peripheral frame 12 but also the inside peripheral frame 11 will hardly bend, thus not separate, respectively. On the other hand, when only one side (front face side) of the inside peripheral frame 11 is bonded, the inside peripheral frame 11 may bend easily and the separation of joining surfaces may be easily caused by the vibration. To avoid this disadvantage, conventionally, before bonding the front face side, the voice coil bobbin 2 and the damper 10 assembled each other are reversed vertically so as to adhere the back face side also. On the other hand, in the construction of the present embodiment, adhesive applied to the front face side flows toward the back face side upon the simple rotation in the circumferential direction of the voice coil bobbin 2 to reduce number of process and cost.

Moreover, as the damper for speaker of the present invention is manufactured by injection molding of thermoplastic resin based on the PBT, the thickness T of the outer peripheral frame 12 may be easily formed thicker than the thickness t of the movable arms 13, 13, while the front and back surfaces of the outer peripheral frame 12 may be easily formed to be protruded in the thickness direction respectively from the front face and the back face of the movable arms 13, 13.

As composed as mentioned above, in the damper for speaker of this embodiment, the adhesion surface between the outer peripheral frame 12 and the speaker frame 6 and between the inside peripheral frame 11 and the voice coil bobbin 2 hardly separate to improve the durability of a speaker unit made by using this damper. Note that the main object of the present invention is to prevent the separation between the outer peripheral frame 12 and the speaker frame 6. Consequently, the notches 14, 14 of the inside peripheral frame 11 may be omitted. Moreover, while the present invention is applied to an elliptic butterfly damper in the illustrated example, it is needless to say the present invention may be applied to a circular butterfly damper.

Figure 6A:
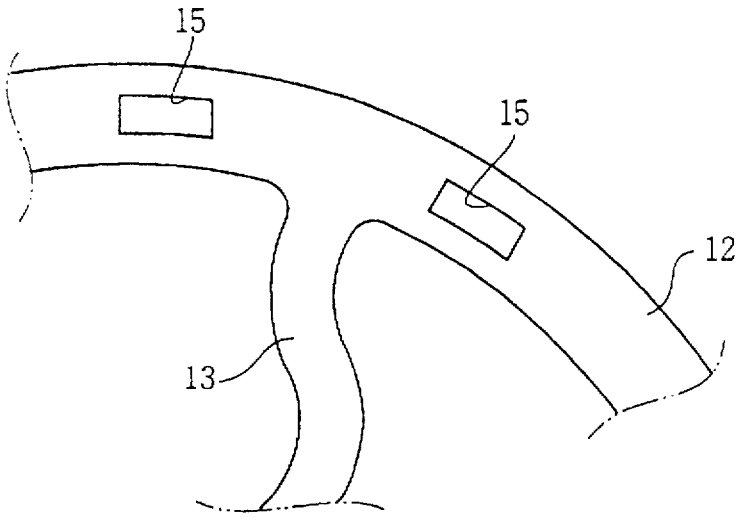
FIGS. 6*a* and 6*b* are partial plane views showing the second embodiment of the present invention.
Figure 6B:
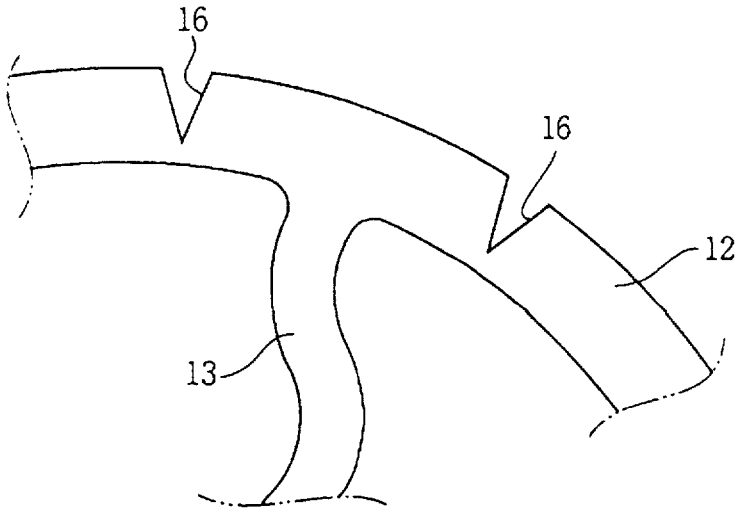

As the second embodiment of the present invention, in order to increase adhesion strength of the outer peripheral frame 12, apertures 15, 15 spaced out each other may be provided on the outer peripheral frame 12 as shown in FIG. 6(A) or notches 16, 16 spaced out each other may be provided on the outer peripheral end of the outer peripheral frame 12 as shown in FIG. 6(B). These apertures 15, 15 and notches 16, 16 correspond to the communication section described in claim 5. The function of these apertures 15, 15 and notches 16, 16 is the same as that of notches 14, 14 of the inside peripheral frame 11 in the construction of the first embodiment mentioned above. The other composition and function are the same as those of the first embodiment mentioned above.

Figure 7:
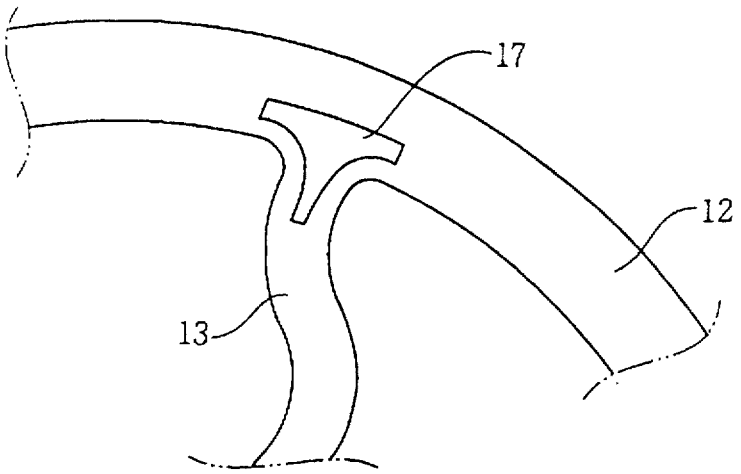
FIG. 7 is a partial plane view showing the third embodiment of the present invention.

As the third embodiment of the present invention, in order to improve stiffness of the connecting section between the outer peripheral frame 12 and the movable arms 13 and to increase bend resistance of the outer peripheral frame 12, a stiffening rib 17 may be provided on the connecting section as shown in FIG. 7. Except providing the stiffening rib 17, the structure is the same as the first embodiment mentioned above.

Figure 8A:
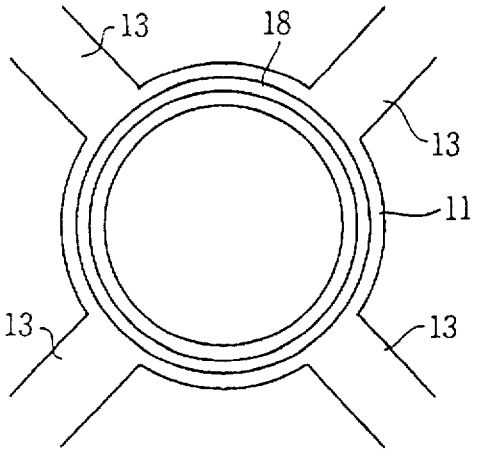
FIGS. 8*a* and 8*b* are partial plane views showing the fourth embodiment of the present invention.
Figure 8B:
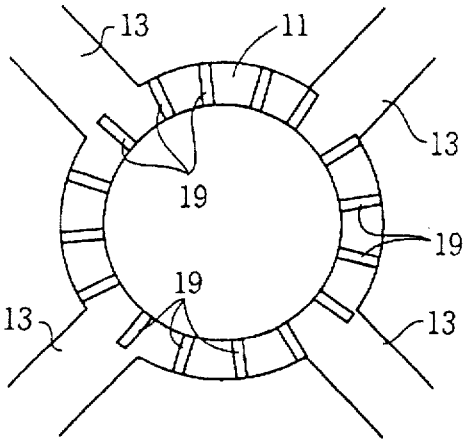
Figure 9:
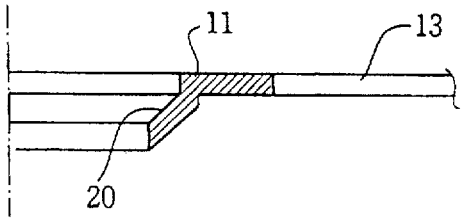
FIG. 9 is a partial plane view showing the fifth embodiment of the present invention.

FIG. 8 shows the fourth embodiment of the present invention. In this embodiment, the bend resistance of the inside peripheral frame 11 is increased so as to improve the stiffness thereof. For this purpose, a stiffening rib 18 may be provided concentrically with the inside peripheral frame 11 on the surface of the inside peripheral frame 11 as shown FIG. 8(A). In this case, the section of this inside peripheral frame 11 is convex. Otherwise, stiffening ribs 19, 19 may be disposed radically with equal distance each other on the surface of the inside peripheral frame 11 as shown in FIG. 8(B). Except providing the stiffening ribs 19, 19, the structure is the same as the first embodiment mentioned above. In place of omitting notches 14, 14 in the structure of the first embodiment mentioned before, as shown in the fifth embodiment of the present invention illustrated in FIG. 9, a liquid reservoir 20 for pooling adhesive may be disposed adjacent to the back face of the inside end of the inside peripheral frame 11 all around the periphery of the inside peripheral frame 11 or with certain interval. Such a liquid reservoir 20 may be constituted by forming a slant boss as illustrated on the back face of the inside peripheral frame 11. The boss may be formed easily by injection molding of synthetic resin based on PBT or the like. It is evident that respective examples mentioned before may be combined conveniently to execute the present invention.

Though the damper for speaker of the present invention may be constructed easily, the adhesion section between the outer peripheral frame and the speaker frame is hard to peel off. Therefore, the durability of the speaker unit composed using the damper of the present invention may be improved.

While the presently preferred embodiments of this invention have been shown and described above, it is to be understood that these disclosures are for the purpose of illustration and that various changes and modifications may be made without departing from the scope of the invention as set forth in the appended claims.

What is claimed is:

1. A damper for speaker comprising:

an inside peripheral frame wherein a voice coil bobbin is inserted;

an outer peripheral frame to be supported by a speaker frame; and a plurality of movable arms bridged between said inside peripheral frame and outer peripheral frame;

wherein said inside and outer peripheral frames and plurality of movable arms are molded respectively in a single piece with thermoplastic resin; and said outer peripheral frame is thicker than said plurality of movable arms.

2. The damper for speaker of claim 1, wherein said outer peripheral frame is protruded in the thickness direction respectively from a front face and a back face of said plurality of movable arms.

3. The speaker damper of claim 1, wherein said thermoplastic resin is a synthetic resin based on polybutyleneterephthalate.

4. The damper for speaker of claim 1, wherein a stiffening rib is provided near a joining section between said outer peripheral frame and movable arms.

5. The damper for speaker of claim 1, wherein a communication section is provided on said outer peripheral frame for communicating the front and back faces of said outer peripheral frame so as to permit adhesive existing on the back face to flow toward the front face.

6. The damper for speaker of claim 1, wherein a stiffening rib is provided on said inside peripheral frame.

7. The damper for speaker of claim 1, wherein a communication section is provided on said inside peripheral frame for communicating the front and back faces of said inside peripheral frame so as to permit adhesive existing on the front face to flow toward the back face.

8. The damper for speaker of any claim 1, wherein a fluid reservoir for adhesive is provided on an inside end section of said inside peripheral frame.

* * * * *